US010619411B2

(12) United States Patent
Wen

(10) Patent No.: US 10,619,411 B2
(45) **Date of Patent: *Apr. 14, 2020**

(54) LIGHT SHIELDING STRUCTURE FOR VERTICAL BLIND

(71) Applicant: NIEN MADE ENTERPRISE CO., LTD., Taichung (TW)

(72) Inventor: Yu-Che Wen, Taoyuan County (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 7 days.

This patent is subject to a terminal disclaimer.

(21) Appl. No.: 15/496,364

(22) Filed: Apr. 25, 2017

(65) Prior Publication Data

US 2017/0226796 A1 Aug. 10, 2017

Related U.S. Application Data

(63) Continuation of application No. 15/000,870, filed on Jan. 19, 2016.

(51) Int. Cl.

| | |
|---|---|
| ***E06B 9/36*** | (2006.01) |
| ***E06B 9/323*** | (2006.01) |
| ***E06B 9/388*** | (2006.01) |

(52) U.S. Cl.

CPC ..... *E06B 9/36* (2013.01); *E06B 9/323* (2013.01); *E06B 9/367* (2013.01); *E06B 9/388* (2013.01)

(58) Field of Classification Search

CPC . E06B 9/36; E06B 9/361; E06B 9/362; E06B 9/364; E06B 9/365; E06B 9/367; E06B 9/368; E06B 9/327

See application file for complete search history.

(56) References Cited

U.S. PATENT DOCUMENTS

| | | | | |
|---|---|---|---|---|
| 435,658 A * | 9/1890 | Brennaman | ..... | E06B 7/2316 49/469 |
| 3,299,943 A * | 1/1967 | Poe | ..... | E06B 9/362 160/176.1 V |
| 5,515,901 A * | 5/1996 | Hall | ..... | E05D 15/264 160/206 |

* cited by examiner

*Primary Examiner* — Katherine W Mitchell
*Assistant Examiner* — Jeremy C Ramsey
(74) *Attorney, Agent, or Firm* — Tracy Heims; Apex Juris, Pllc.

(57) ABSTRACT

A light shielding structure for a vertical blind is disclosed, wherein the vertical blind includes a headrail and a plurality of slats, which are hanged under the headrail in a vertical manner, and can be controlled to be turned between a shielding position and a non-shielding position. The vertical blind includes at least one light shielding member, which is engaged to a bottom of the headrail, and can either be flipped up or naturally droop along with the turning of the slats. When the at least one light shielding member droops, gaps formed between the bottom of the headrail and a top of the slats are covered, which prevents light from leaking in therethrough.

18 Claims, 8 Drawing Sheets

LIGHT SHIELDING STRUCTURE FOR VERTICAL BLIND

CROSS-REFERENCE TO RELATED APPLICATION

This is a Continuation application of U.S. patent application Ser. No. 15/000,870 filed Jan. 19, 2016. The entire contents of which are incorporated herein by reference.

BACKGROUND OF THE INVENTION

1. Technical Field

The present invention relates generally to window blinds, and more particularly to a light shielding structure adapted to be used for a vertical blind, wherein the light shielding structure can improve the effect of shielding light.

2. Description of Related Art

Various types of window coverings are available on the market, and the window coverings which have slats can be classified into two types according to the arrangement of the slats, including vertical blinds and horizontal blinds. However, no matter for what types of window coverings, gaps tend to be left between the covering and the window frame, which may cause the problem of light leakage.

Take a vertical blind for example; it includes a headrail to be installed at a top edge of a window frame or on a wall, wherein a plurality of slats are arranged along a long axis of the headrail in a vertically hanged manner. The slats can be turned in response to the control of an adjusting mechanism, by which to perform the function of shielding light or allowing light to come in. In order to ensure the smoothness in turning the slats, a conventional vertical blind leaves a narrow gap between a bottom surface of the headrail and a top edge of the slats, so that the slats do not contact with the headrail while being turned. However, no matter the vertical blind is closed to shield light or is open to allow light to come in, the gap left between the bottom surface of the headrail and the top edge of the slats is likely to cause a light leakage.

BRIEF SUMMARY OF THE INVENTION

In view of the above, the primary objective of the present invention is to provide a light shielding structure for a vertical blind, wherein the light shielding structure can reduce the light leakage, and improve the effect of shielding light.

The present invention provides a light shielding structure for a vertical blind, wherein the vertical blind comprises a headrail and a plurality of slats, which are hanged under the headrail in a vertical manner, and can be controlled to be turned between a shielding position and a non-shielding position. The light shielding structure is characterized in that, at least one light shielding member is engaged with the headrail, wherein the at least one light shielding member is arranged along a portion of the headrail where the slats are hanged thereto; when the slats are at the shielding position, the at least one light shielding member naturally droops to cover gaps left between the headrail and a top of the slats; while the slats are being turned from the shielding position to the non-shielding position, the at least one light shielding member is flipped up for being pushed by the top of the slats; when the slats are at the non-shielding position, a bottom edge of the at least one light shielding member rests on a top edge at the top of the slats.

Whereby, along with the turning of the slats, the light shielding member can either be easily flipped up or naturally droop. When the slats are open, the light shielding member is flipped up, and therefore does not hinder light from coming in; when the slats are closed, the light shielding member droops naturally, and therefore covers the gap between the bottom of the headrail and the top of the slats, which prevents the problem of light leakage.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 2:
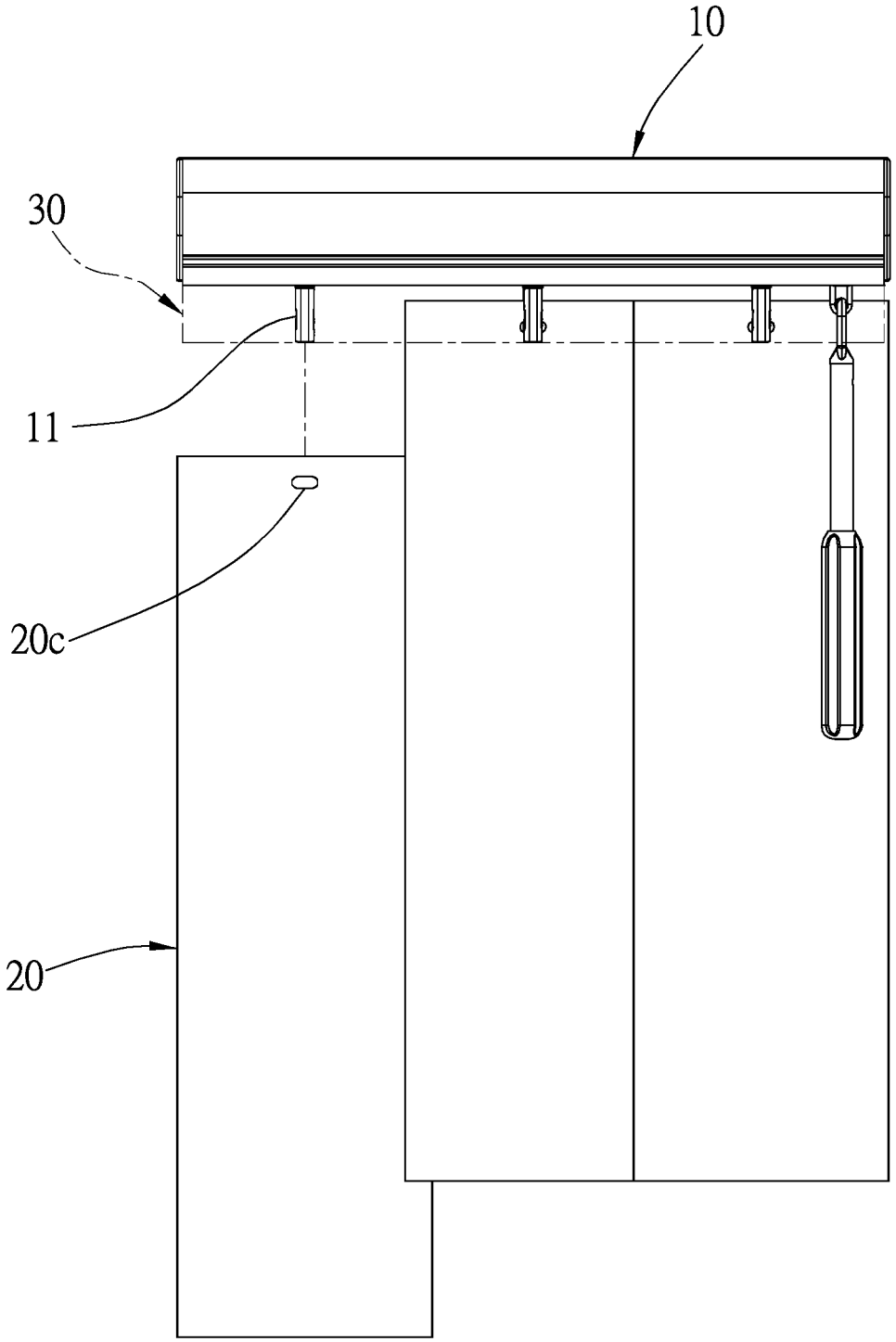
FIG. 2 is a front view of FIG. 1.
Figure 3:
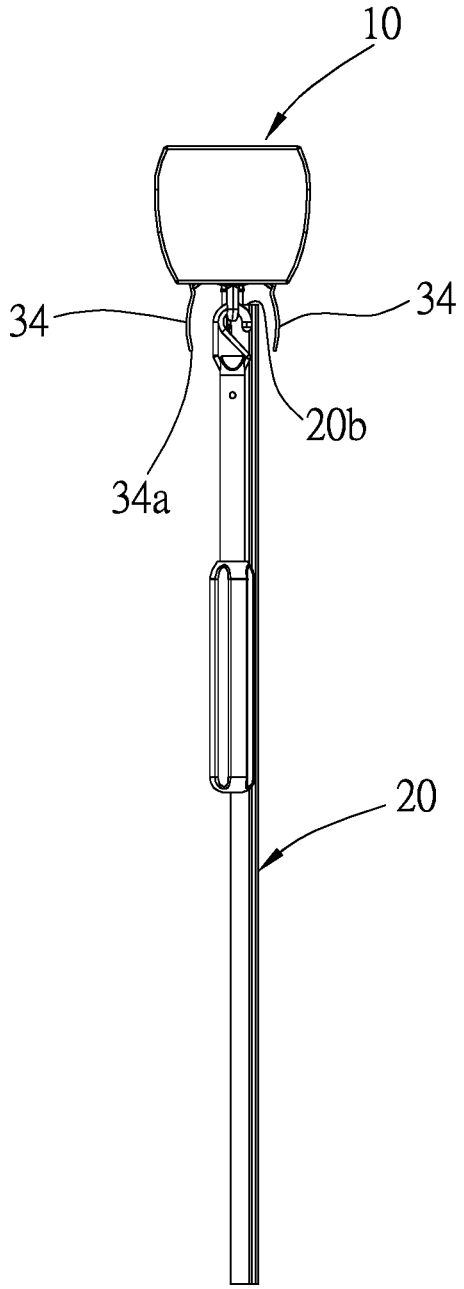
FIG. 3 is a right side view of FIG. 1.

A vertical blind 100 illustrated in FIG. 1 to FIG. 3 includes a light shielding structure of a preferred embodiment of the present invention, and includes a headrail 10 and a plurality of slats 20, wherein the headrail 10 is installed at a top edge of a window or a frame of a building; the slats 20 are vertically arranged along a long axis of the headrail 10 in a parallel manner, and are hanged below the headrail 10. Each of the slats 20 respectively has a through hole 20*c*, and the headrail 10 has an adjusting mechanism (not shown) provided therein, wherein the adjusting mechanism includes a plurality of clips 11, each of which correspondingly passes through the through hole 20*c* of one of the slats 20 to hang the relevant slat 20, which makes the slats 20 movable by the adjusting mechanism. More specifically, the slats are synchronously turned between a shielding position and a non-shielding position, wherein the shielding position mentioned herein refers to the condition that neighboring slats 20 are partially overlapped, and the non-shielding position mentioned herein refers to the condition that the slats 20 are parallel to each other, which allows light from outside to come in through the gaps between each two neighboring slats 20. In this way, the slats 20 can be either closed to shield light or open to let light in. However, the adjusting mechanism is a conventional art, and therefore we are not going to describe its details herein.

Figure 4:
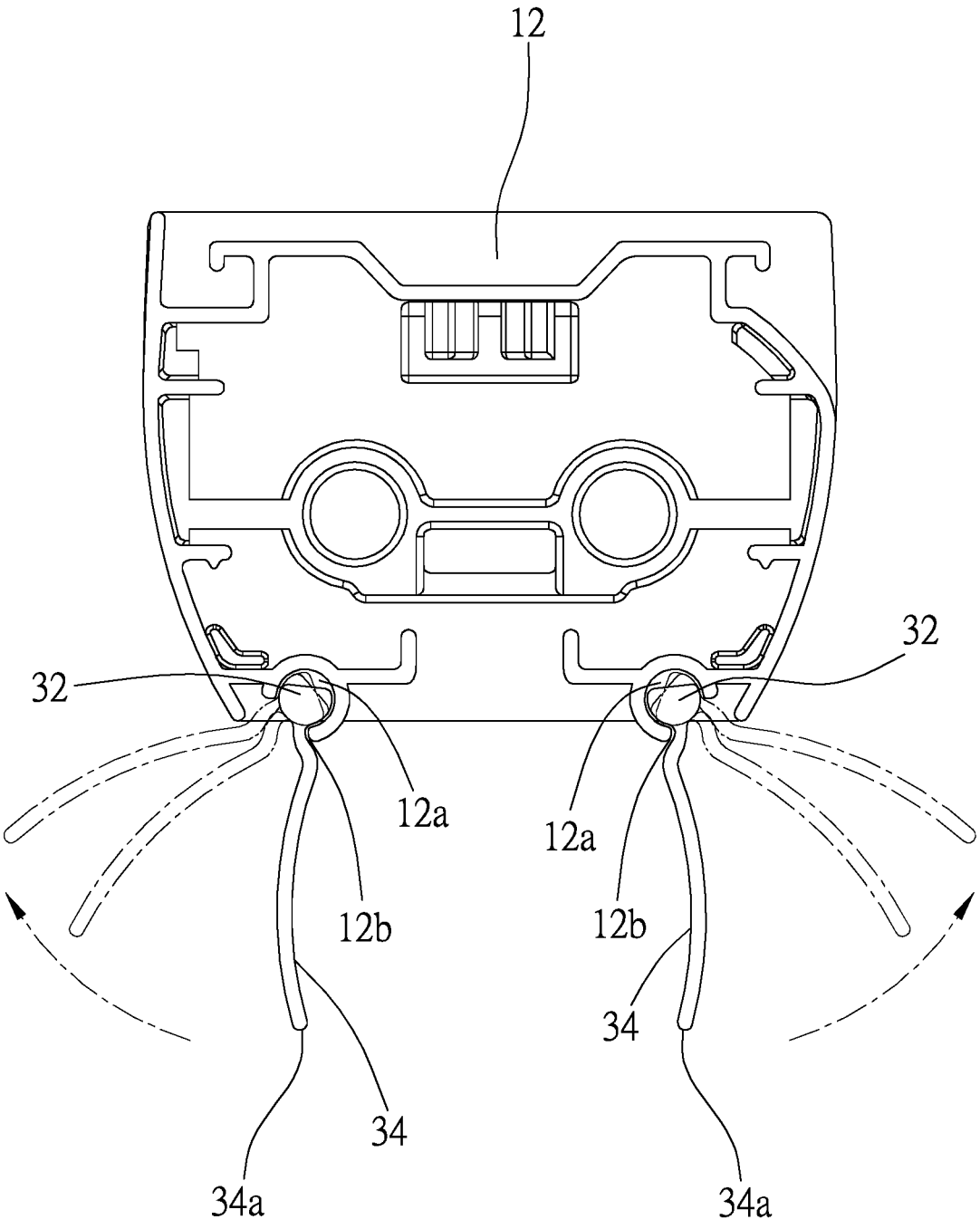
FIG. 4 is a schematic view of the case and the light shielding member of the vertical blind of the aforementioned preferred embodiment.

The headrail 10 in the preferred embodiment includes a hollow case 12 and two side covers 14. As shown in FIG. 4, the case 12 in the preferred embodiment is made of metal or extruded plastic as an example, and two insertion grooves

12*a* are integrally formed on a bottom thereof, wherein the insertion grooves 12*a* are formed along a long axis of the case 12, and each has a lateral opening 12*b*. The side covers 14 respectively engage with two sides of the case 12 to seal two ends of each of the insertion grooves 12*a*.

The light shielding structure of the present invention includes at least one light shielding member. In the current preferred embodiment, there are two light shielding members 30 included as an example. The light shielding members 30 are thin plates, and each of the light shielding members 30 has substantially identical length with the headrail 10. Each of the light shielding members 30 includes a rod 32 and an extending plate 34, which is connected to the rod 32, and has a certain width. To assemble the light shielding structure, the rod 32 of each of the light shielding members 30 is inserted into one of the insertion grooves 12*a* first, wherein the extending plate 34 of each of the relevant light shielding members 30 passes through the corresponding lateral opening 12*b*; after that, the side covers 14 are engaged with two ends of the case 12, so that the light shielding members 30 are connected to a bottom of the headrail 10, and can be flipped, wherein the extending plates 34 of the light shielding members 30 are respectively located on the outside in front of and behind the slats 20.

In practice, the length of the light shielding members 30 at least has to be as long as the length of one portion of the headrail 10 where the slats 20 are hanged thereto. Both the light shielding members 30 naturally droop when the slats 20 are at the shielding position, as shown in FIG. 3. At this time, the light shielding members 30 cover the gaps formed between the bottom of the headrail 10 and a top edge 20*b* of the slats 20. In other words, a bottom edge 34*a* of each of the extending plates 34 is lower than the top edge 20*b* of the slats 20, which makes the extending plates 34 cover the lateral sides at the top of the slats 20 without contacting with the slats 20. It is preferred that the bottom edge 34*a* of each of the extending plates 34 is at least lower than a bottom edge of the through hole 20*c* of each of the slats 20 to prevent light from leaking in therethrough, which improves the effect of shielding light.

Figure 1:
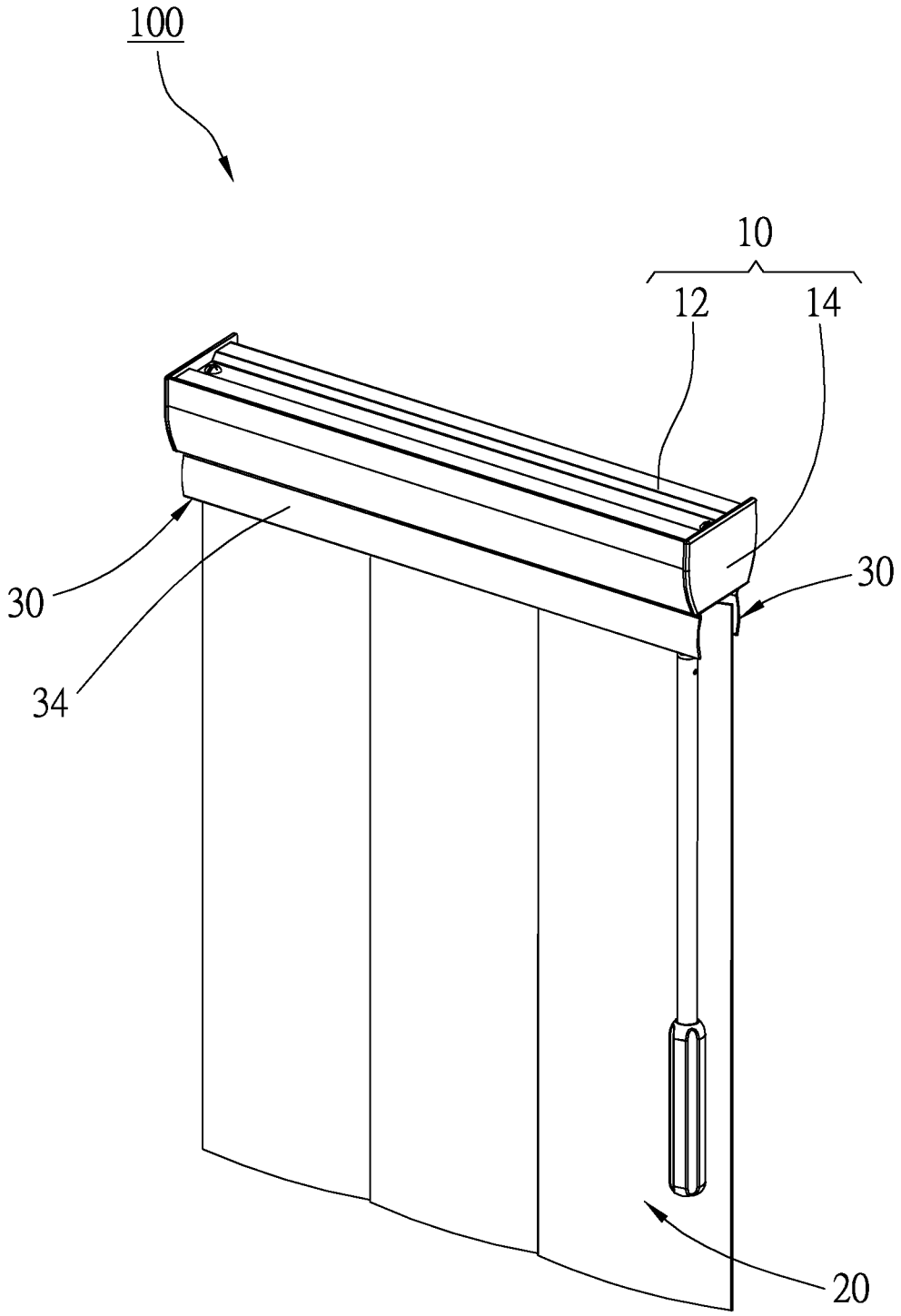
FIG. 1 is a perspective view of a vertical blind of a preferred embodiment, showing the slats are closed to shield light.
Figure 5:
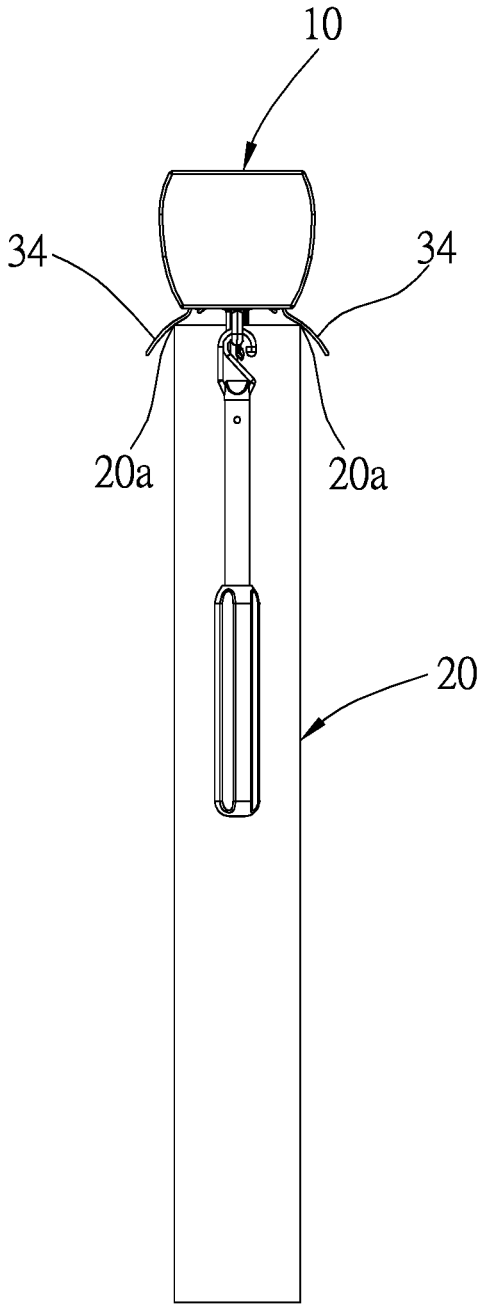
FIG. 5 and FIG. 6 are similar to FIG. 3, showing the slats are turned and the light shielding member is flipped up.
Figure 6:
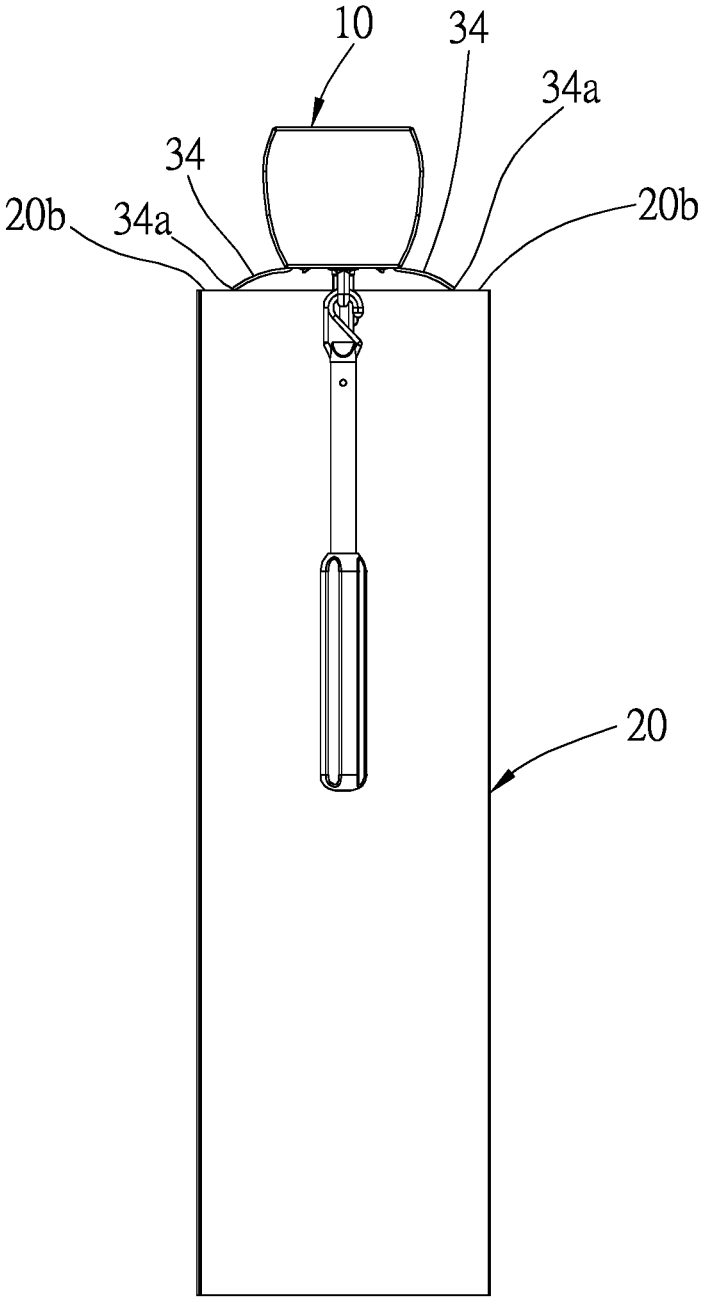
Figure 7:
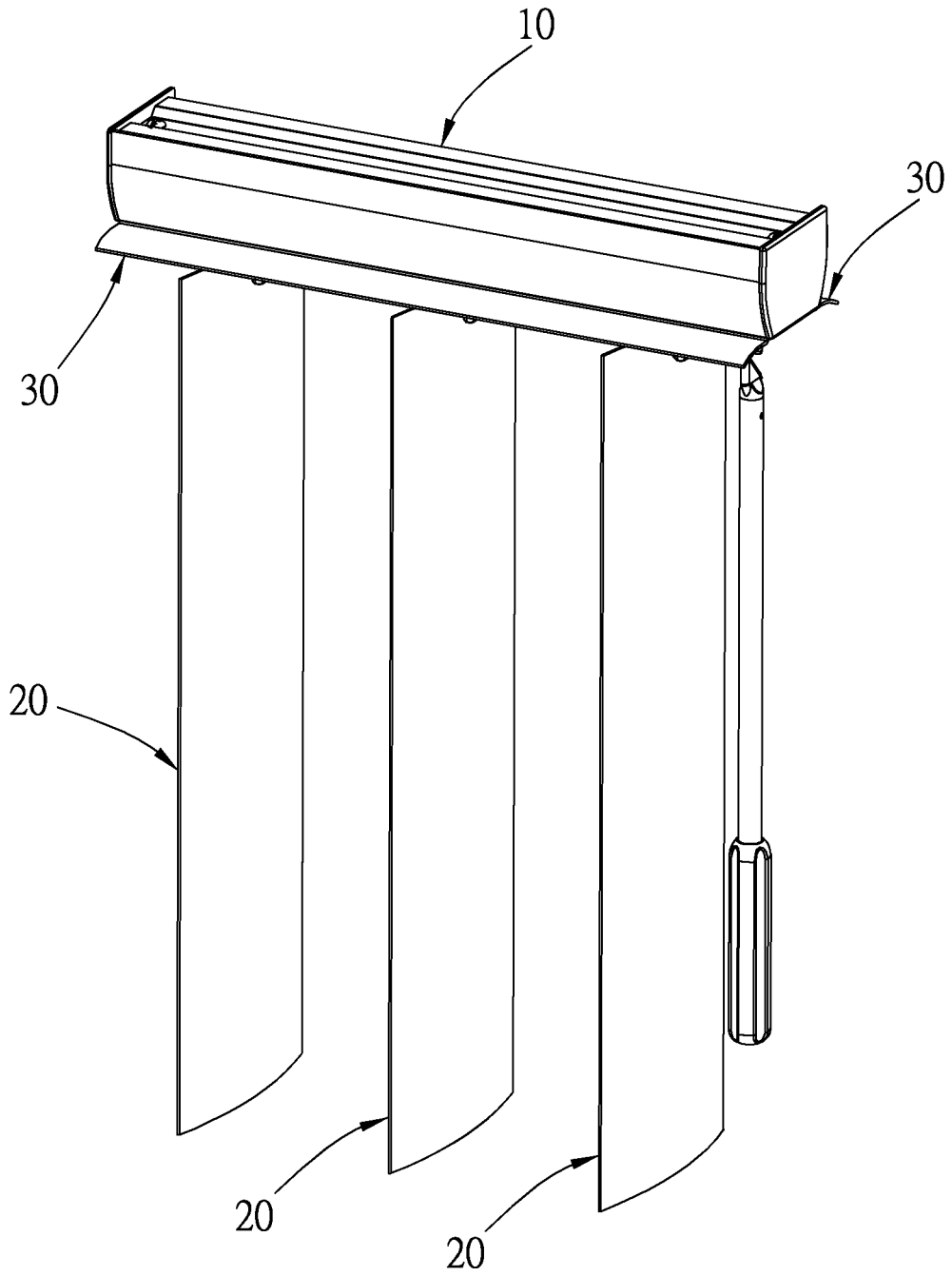
FIG. 7 is a perspective view, showing the slats stay in the non-shielding position.

On the contrary, during the process of controlling the adjusting mechanism to turn the slats 20 from the shielding position shown in FIG. 1 to the non-shielding position shown in FIG. 7, corners 20*a* at the top of each of the slats 20 gradually moves outward along with the turning of the slats 20. As shown in FIG. 5 and FIG. 6, the slats 20 push against an inner wall of the extending plates 34 of the light shielding members 30 with the corners 20*a* thereof while being turned, whereby the extending plates 34 of the light shielding members 30 are gradually flipped upward by the corners 20*a* of the slats 20, which are moving outward, till the corners 20*a* at the top of the slats 20 no longer contact with the extending plates 34. After that, while the slats 20 are approaching the non-shielding position and finally stop at the non-shielding position, the bottom edge 34*a* of each of the extending plates 34 rests on the top edge 20*b* of the slats 20. As a result, the light shielding members 30 would barely shield light when the slats are open. Furthermore, when the adjusting mechanism is controlled to move the slats 20 back to the shielding position, the light shielding members 30 naturally droop due to their weight, and therefore the gaps left between the bottom surface of the headrail 10 and the top edge of the slats 20 are covered again.

Figure 8:
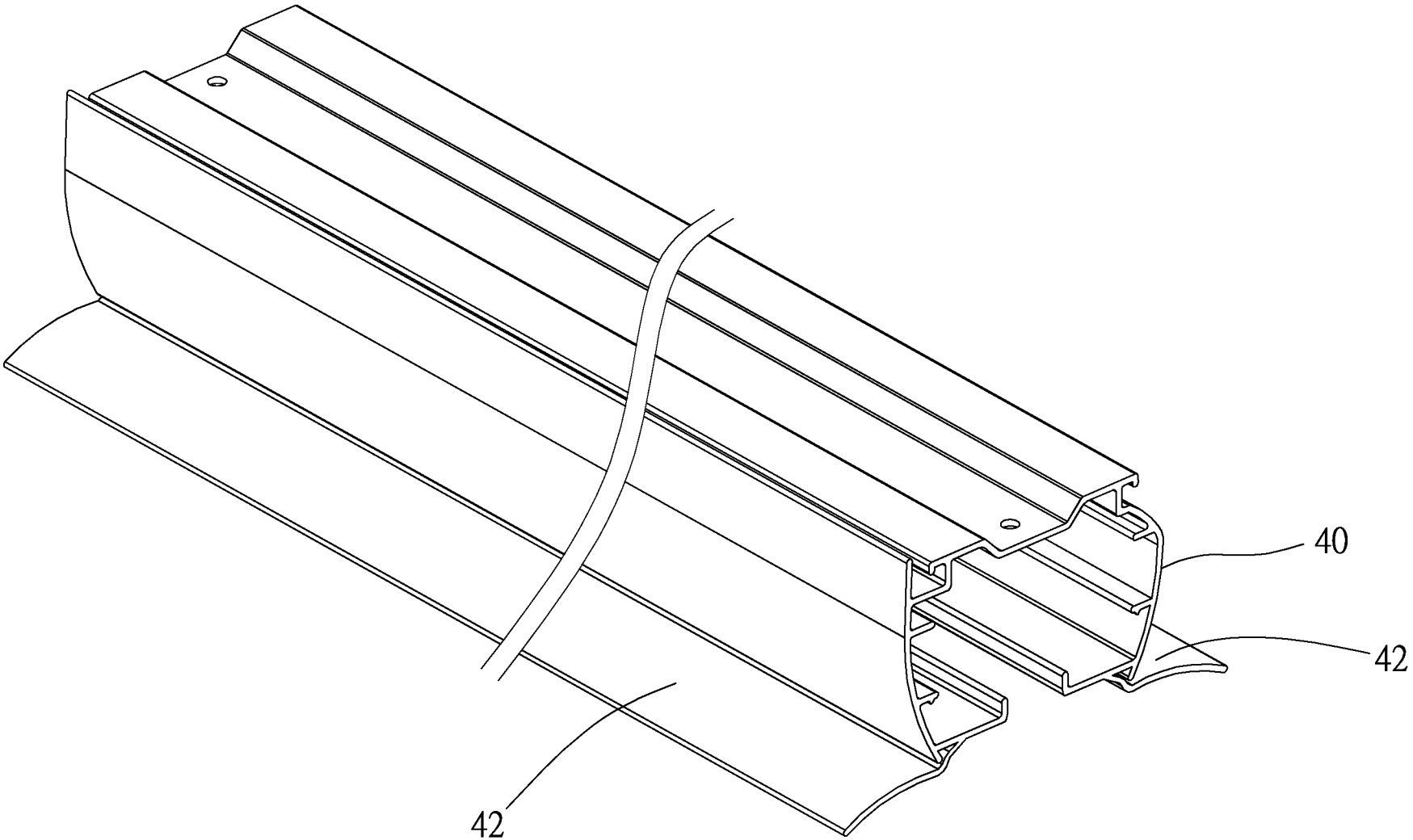
FIG. 8 is a schematic view of the case and the light shielding member of a vertical blind of an alternative preferred embodiment.

In the current preferred embodiment, the light shielding members 30 are assembled and positioned by inserting the rods 32 into the insertion grooves 12*a* of the case 12. However, in practice, each of the insertion grooves 12*a* is not necessary to be narrow and long, but can be also composed of a plurality of short grooves which are arranged along a long axis of the bottom of the case 12. Similarly, the rod 32 of each of the light shielding members 30 is not necessary to be integral, but can be also composed of a plurality of short rods. As long as the short rods and the short grooves correspond to each other, the light shielding members 30 can be still engaged with the case 12, and can be moved and flipped relative to the headrail 10 as well. Alternatively, each of the rods 32 can have a through hole provided along a long axis therein, wherein the through hole can be inserted by a rod (not shown), and two ends of the rod are respectively connected the side covers 14, which makes the light shielding members 30 pivotally connected to the headrail 10. With such design, while the slats 20 are being turned, the light shielding members 30 can be flipped up or can droop more easily. In addition, an alternative preferred embodiment is illustrated in FIG. 8, while the case 40 of the headrail 10 in said preferred embodiment are being made of plastic in an integral manner, the light shielding members 42 can be integrally connected to the bottom in front of and behind the case 40, wherein the light shielding members 42 are flexible, and therefore can either be easily flipped up or droop along with the turning of the slats 20. The operation is similar to that described in the previous preferred embodiment, wherein, during the process of turning the slats 20 from the non-shielding position to the shielding position, the bottom edges of the light shielding members 42 originally rests on the top edge of the slats 20, and eventually, the bottom edges of the light shielding members 42 are lower than the top edge of the slats 20 to cover sides at the top of the slats 20, whereby the objective of shielding light can be achieved.

In addition to preventing the problem of light leakage, the present invention can also improve the overall appearance of the vertical blind by using the same material for the extending plate of each of the light shielding members and the case, wherein the extending plate of each of the light shielding members and the case can be designed to have a consistent visual effect. Furthermore, when the slats are turned to the non-shielding position, and the bottom edges of the extending plates of the light shielding member rest on the top edge of the slats, the slats are more unlikely to be turned if applied with force other than that provided by the adjusting mechanism (e.g., the wind). In other words, the angel of the slats is more resist, whereby the noises which may be caused during the turning of the slats can be avoided if the slats are turned by force other than that provided by the adjusting mechanism.

It must be pointed out that the embodiments described above are only some preferred embodiments of the present invention. All equivalent structures which employ the concepts disclosed in this specification and the appended claims should fall within the scope of the present invention.

What is claimed is:

1. A vertical blind, comprising:

a headrail;

a plurality of slats, which are hung under the headrail in a vertical manner along a long axis of the headrail, and can be controlled to be turned between a shielding position and a non-shielding position; and at least one light shielding member, which has a coupling portion coupled to the headrail along a portion of the headrail where the slats are hung thereto;

wherein, when the slats are at the shielding position, the at least one light shielding member naturally droops to cover gaps left between the headrail and a top of the slats;

while the slats are being turned between the shielding position and the non-shielding position, an inner wall of each of the at least one light shielding member is pushed against by a corner at the top of the slats, whereby to flip up the at least one light shielding member;

wherein the at least one light shielding member has an elongated section including a first end proximal to the headrail, a second end distal to the headrail, and a convex curved section extending substantially from the first end to the second end, and wherein the convex curved section has a curvature bulging outward and a bulging direction of the curvature of the at least one light shielding member is away from the slats in a horizontal direction when the at least one light shielding member is in the shielding position.

2. The vertical blind of claim 1, wherein the headrail comprises a hollow case, which has at least one insertion groove provided along a long axis thereof, wherein the long axis of the case is parallel to the long axis of the headrail; each of the at least one insertion groove has a lateral opening formed along the long axis of the case; each of the at least one light shielding member has a rod and an extending plate, wherein the rod is inserted into one of the at least one insertion groove, and the extending plate is connected to the rod through the lateral opening of the corresponding one of the at least one insertion groove; wherein the rod is the coupling portion of the at least one light shielding member coupled to the headrail.

3. The vertical blind of claim 2, wherein the extending plate is partially pivotable relative to the case with the rod as a pivoting center; the inner wall of each of the at least one light shielding member pushed against by the corner at the top of the slats while the slats are being turned between the shielding position and the non-shielding position is an inner wall of the extending plate; when the slats are at the shielding position, the bottom edge of the extending plate is lower than the top edge of the slats, so that the extending plate covers a side at the top of the slats.

4. The vertical blind of claim 1, wherein the headrail comprises an integrally made case; the coupling portion of the at least one light shielding member is integrally connected to the case.

5. The vertical blind of claim 4, wherein the at least one light shielding member is flexible to be flipped up or to droop.

6. The vertical blind of claim 1, further comprising an adjusting mechanism provided in the headrail, wherein the adjusting mechanism comprises a plurality of clips; each of the slats has a through hole, wherein each of the clips correspondingly passes through the through hole of one of the slats to hang the relevant slat; when the slats are at the shielding position, the bottom edge of the at least one light shielding member is at least lower than a bottom edge of the through hole of each of the slats.

7. A vertical blind, comprising:

a headrail;

a plurality of slats, which are hung under the headrail in a vertical manner along a long axis of the headrail, and can be controlled to be turned between a shielding position and a non-shielding position, wherein each of the slats turns in situ; and at least one light shielding member, which has a coupling portion coupled to the headrail along a portion of the headrail where the slats are hung thereto;

wherein, when the slats are at the shielding position, the at least one light shielding member naturally droops to cover gaps left between the headrail and a top of the slats; while the slats are being turned in situ from the shielding position to the non-shielding position, the at least one light shielding member is flipped up for being pushed by the slats;

wherein the at least one light shielding member has an elongated section including a first end proximal to the headrail, a second end distal to the headrail, and a convex curved section extending substantially from the first end to the second end, and wherein the convex curved section has a curvature bulging outward and a bulging direction of the curvature of the at least one light shielding member is away from the slats in a horizontal direction when the at least one light shielding member is in the shielding position.

8. The vertical blind of claim 7, wherein the headrail comprises a hollow case, which has at least one insertion groove provided along a long axis thereof, wherein the long axis of the case is parallel to the long axis of the headrail; each of the at least one insertion groove has a lateral opening formed along the long axis of the case; each of the at least one light shielding member has a rod and an extending plate, wherein the rod is inserted into one of the at least one insertion groove, and the extending plate is connected to the rod through the lateral opening of the corresponding one of the at least one insertion groove; wherein the rod is the coupling portion of the at least one light shielding member coupled to the headrail.

9. The vertical blind of claim 8, wherein the extending plate is partially pivotable relative to the case with the rod as a pivoting center; while the slats are being turned in situ between the shielding position and the non-shielding position, an inner wall of the extending plate is pushed against by a corner at the top of the slats; when the slats are at the shielding position, the bottom edge of the extending plate is lower than the top edge of the slats, so that the extending plate covers a side at the top of the slats.

10. The vertical blind of claim 7, wherein the headrail comprises an integrally made case; the coupling portion of the at least one light shielding member is integrally connected to the case.

11. The vertical blind of claim 10, wherein the at least one light shielding member is flexible to be flipped up or to droop.

12. The vertical blind of claim 7, further comprising an adjusting mechanism provided in the headrail, wherein the adjusting mechanism comprises a plurality of clips; each of the slats has a through hole, wherein each of the clips correspondingly passes through the through hole of one of the slats to hang the relevant slat; when the slats are at the shielding position, the bottom edge of the at least one light shielding member is at least lower than a bottom edge of the through hole of each of the slats.

13. A vertical blind, comprising:

a headrail;

a plurality of slats, which are hung under the headrail in a vertical manner along a long axis of the headrail, and can be controlled to be turned between a shielding position and a non-shielding position around a turning axis, wherein the turning axis for each of the slats is a vertical middle line thereof; and at least one light shielding member, which has a coupling portion coupled to the headrail along a portion of the headrail where the slats are hung thereto;

wherein, when the slats are at the shielding position, the at least one light shielding member naturally droops to cover gaps left between the headrail and a top of the slats; while the slats are being turned around the vertical middle lines thereof from the shielding position to the non-shielding position, the at least one light shielding member is flipped up for being pushed by the slats;

wherein the at least one light shielding member has an elongated section including a first end proximal to the headrail, a second end distal to the headrail, and a convex curved section extending substantially from the first end to the second end, and wherein the convex curved section has a curvature bulging outward and a bulging direction of the curvature of the at least one light shielding member is away from the slats in a horizontal direction when the at least one light shielding member is in the shielding position.

14. The vertical blind of claim 13, wherein the headrail comprises a hollow case, which has at least one insertion groove provided along a long axis thereof, wherein the long axis of the case is parallel to the long axis of the headrail; each of the at least one insertion groove has a lateral opening formed along the long axis of the case; each of the at least one light shielding member has a rod and an extending plate, wherein the rod is inserted into one of the at least one insertion groove, and the extending plate is connected to the rod through the lateral opening of the corresponding one of the at least one insertion groove; wherein the rod is the coupling portion of the at least one light shielding member coupled to the headrail.

15. The vertical blind of claim 14, wherein the extending plate is partially pivotable relative to the case with the rod as a pivoting center; while the slats are being turned around the vertical middle lines thereof between the shielding position and the non-shielding position, an inner wall of the extending plate is pushed against by a corner at the top of the slats; when the slats are at the shielding position, the bottom edge of the extending plate is lower than the top edge of the slats, so that the extending plate covers a side at the top of the slats.

16. The vertical blind of claim 13, wherein the headrail comprises an integrally made case; the coupling portion of the at least one light shielding member is integrally connected to the case.

17. The vertical blind of claim 16, wherein the at least one light shielding member is flexible to be flipped up or to droop.

18. The vertical blind of claim 13, further comprising an adjusting mechanism provided in the headrail, wherein the adjusting mechanism comprises a plurality of clips; each of the slats has a through hole, wherein each of the clips correspondingly passes through the through hole of one of the slats to hang the relevant slat; when the slats are at the shielding position, the bottom edge of the at least one light shielding member is at least lower than a bottom edge of the through hole of each of the slats.

* * * * *